United States Patent [19]

Thompson et al.

[11] Patent Number: 4,887,767

[45] Date of Patent: Dec. 19, 1989

[54] LIMIT SWITCH CONTROL METHOD FOR A TWO-STAGE FURNACE

[75] Inventors: Kevin D. Thompson; Gary W. Ballard, both of Indianapolis, Ind.

[73] Assignee: Carrier Corporation, Syracuse, N.Y.

[21] Appl. No.: 260,973

[22] Filed: Oct. 21, 1988

[51] Int. Cl.[4] ..... G05D 23/12

[52] U.S. Cl. ..... 236/1 EB; 236/9 R; 236/10; 340/588

[58] Field of Search ..... 236/10, 11, 9 R, 1 EB; 340/588; 431/78

[56] References Cited

U.S. PATENT DOCUMENTS 3,523,643 8/1970 Caparone et al. ..... 236/9
4,315,296 2/1982 Hancock ..... 340/588 X
4,421,268 12/1983 Bassett et al. ..... 236/10
4,638,942 1/1987 Ballard et al. ..... 236/10

*Primary Examiner*—William E. Wayner
*Attorney, Agent, or Firm*—Dana F. Bigelow

[57] ABSTRACT

A two-stage gas furnace control system automatically shifts into a high fire only mode if, in two consecutive low fire heating cycles a limit switch is tripped to indicate that a gas valve is stuck in a high fire condition. In this way, continued operation is allowed to proceed in a safe manner. Provision is also made to lock out the system from further operation if, while in the high fire only mode, the limit switch is tripped in a predetermined consecutive number of cycles or if, while in a preemptive low fire only mode, the limit switch is tripped.

13 Claims, 3 Drawing Sheets

LIMIT SWITCH CONTROL METHOD FOR A TWO-STAGE FURNACE

BACKGROUND OF THE INVENTION

The present invention relates to furnaces and, more particularly, to a method of controlling a two-stage, gas-fired furnace.

In order to obtain increased efficiencies, it has become common practice to provide two stages of operation in a furnace, the first stage operating the furnace on low heat and the second stage operating the furnace on high heat. Generally, the low heat level of operation will be used where possible to thereby obtain increased operating efficiencies. When higher heating inputs are required, as, for example, when the actual temperature does not reach the set temperature within a predetermined time period of operation in a low heat operating condition. It is also common to initially operate in a high heat mode in order that proper burner light off is achieved and that the heat exchangers are quickly warmed up.

In changing between low and high heat modes of operation, there are three parameters which must be changed. First, the inducer motor speed must be set for either low or high speed so as to provide the appropriate amount of combustion air. Secondly, the gas valve must be placed in either the low or high fuel flow position to properly match the amount of combustion air from the inducer. This is commonly accomplished by either opening or closing the high fire solenoid valve. Finally, the blower must be operated at either high or low speed to accommodate the amount of heat that is being generated.

It is possible that a high fire solenoid will be closed to provide the high flow rate of gas when the furnace is operating in a low fire mode. This may occur, for example, when the system has been operating initially in a high fire mode and then switches to a low fire mode but with the high fire solenoid tending to stick in the closed position. If this occurs, poor combustion will result, which is undesirable for reasons of efficiency and safety. A system will normally respond to such a condition by sensing the resulting higher temperatures and responsively turning off the gas and the inducer, and then after an appropriate reset time period, the cycle is commenced again. If the valve remains in the stuck position, the system will continue to operate in shortened cycles and the heat output will not be adequate. Further, the system will continue to experience poor combustion on a repeated basis.

It is therefore an object of the present invention to provide an improved control system for a two-stage furnace.

Another object of the present invention is the provision in a two-stage furnace for the prevention of poor combustion conditions.

Yet another object of the present invention is the provision in a two-stage furnace for reducing the repeated occurrences of a particular fault condition.

Still another object of the present invention is the provision in a two-stage furnace for accommodating the condition of having the high fire solenoid on during periods when the system should be operating in a low fire mode.

Still another object of the present invention is the provision for a two-stage furnace control system which is economical to manufacture and effective in use.

These objects and other features and advantages become more readily apparent upon reference to the following description when taken in conjunction with the appended drawings.

SUMMARY OF THE INVENTION

Briefly, in accordance with one aspect of the invention, if the system senses what appears to be a closed high heat solenoid valve during low fire operation, the system will automatically restrict itself to high heat operation only. In this mode, the system can continue to operate in a satisfactory manner to satisfy the thermostat setting without the occurrence of poor combustion. If, while in this high heat only mode of operation, undesirable conditions are still sensed in each of a predetermined number of consecutive cycles, then the system will automatically lock out from further operation.

In accordance with another aspect of the invention, there is provided a limit switch which is responsive to excessive temperatures in the circulating air chamber across the heat exchanger. If the limit switch opens, the system operates to shut off the gas, bring on the blower at high speed, and then resume normal operation after the limit switch resets. If the limit switch opens once in each of two consecutive cycles while in the low fire condition, then the system concludes that there is a stuck high heat solenoid and the system will automatically restrict its operation to high heat only. This will continue until the power is reset, in which case normal heating operation is resumed, or unless a preemptive command causes the system to go into a low fire only mode of operation.

By yet another aspect of the invention, after the system has gone into a high heat only mode of operation, a predetermined fault condition or a configuration switch setting that would normally select the low fire only mode of operation may be imposed on the system. If this occurs and the limit switch opens during that cycle, the system will automatically lock out.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
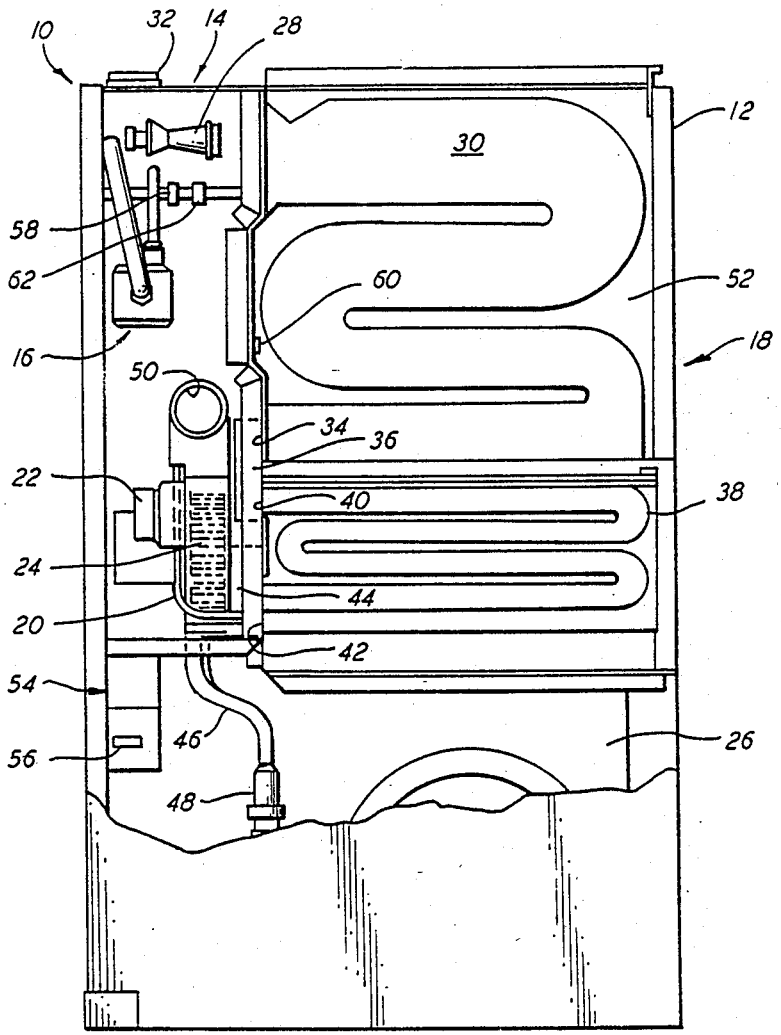
FIG. 1 is a partially broken-away side elevational view of a furnace incorporating the principles of the present invention.

Referring to FIG. 1, there is illustrated a gas-fired furnace which may be operated according to the principles of the present invention. The following description is made with reference to condensing furnace 10, but it should be understood that the present invention also contemplates incorporation into a noncondensing-type furnace.

Referring now to FIG. 1, condensing furnace 10 includes, in major part, steel cabinet 12, housing therein a burner assembly box 14, combination gas control 16, heat exchanger assembly 18, inducer housing 20 supporting inducer motor 22 and inducer wheel 24, and circulating air blower 26. Combination gas control 16 includes pilot circuitry for controlling and proving the pilot flame. This pilot circuitry or control can be a Hamilton Standard Controls model 740A pilot obtainable from Hamilton Standard Controls, New Lexington, Ohio. Combination gas control 16 is designed to provide dual rates of gas flow to burner assembly 14, i.e. either a low gas flow rate or a high gas flow rate by selectively closing (low heat) or opening (high heat) a solenoid valve (not shown) within the gas control 16.

Burner assembly 14 includes at least one inshot burner 28 for at least one primary heat exchanger 30. Burner 28 receives a flow of combustible gas from combination gas control 16, and the inducer wheel 24 draws a flow of combustion air through combustion air inlet 32 to be mixed with the gas delivered to burner 28 for combustion. The resulting combustion gases then enter the heat exchanger 30 where a portion of its heat is given up to the air flowing up over the heat exchanger.

Primary heat exchanger 30 includes an outlet 34 opening into chamber 36. Connected to chamber 36 and in fluid communication therewith are four condensing heat exchangers 38, only one of which is shown, and having an inlet 40 and an outlet 42. Outlet 42 opens into chamber 44 for venting exhaust flue gases and condensate.

Inducer housing 20 is connected to chamber 44 and has mounted therewith inducer motor 22 with inducer wheel 24 for drawing the combusted fuel air mixture from burner assembly 14 through the heat exchanger assembly 18. Air blower 26 delivers air to be heated upwardly through air passage 52 and over heat exchanger assembly 18, and the cool air passing over condensing heat exchangers 38 lowers the heat exchanger wall temperature below the dew point of the combusted fuel air mixture causing a portion of the water vapor in the combusted fuel air mixture to condense, thereby recovering a portion of the sensible and latent heat energy. The condensate formed within heat exchangers 38 flows through chamber 44 into drain tube 46 to condensate trap assembly 48. As air blower 26 continues to urge a flow of air to be heated upwardly through heat exchanger assembly 18, heat energy is transferred from the combusted fuel air mixture flowing through heat exchanger 30 and 38 to heat the air circulated by blower 26. Finally, the combusted fuel air mixture that flows through heat exchangers 30 and 38 exits through outlet 42 and is then delivered by inducer motor 22 through exhaust gas outlet 50 and thence to a vent pipe (not shown). Both inducer motor 22 and the motor (not shown) for air blower 26 are preferably electronically commutated to provide variable speed operation.

Cabinet 12 also houses microprocessor control 54, LED display 56, low pressure switch 58, and high pressure switch 62. Switches 58 and 62 are disposed on the inducer housing 20 and are plumbed in parallel such that each senses the differential pressure between the chamber 44 and burner assembly box 14. Low pressure switch 58 closes as the pressure increases above a first predetermined pressure and will open when the pressure decreases below the first predetermined pressure. High pressure switch 62 operates similarly in response to a second predetermined pressure that is greater than the first predetermined pressure. The setpoints of the low and high pressure switches 58 and 62 respectively are selected to ensure that combustion does not exceed allowable carbon monoxide limits during vent blockages and overfire conditions and during high-to-low fire transitions.

A temperature sensitive limit switch 60 is placed in the air passage 52 to ensure that there is adequate circulating airflow across the heat exchanger assembly 18. This switch is a conventional bymetal actuated, normally closed switch which is designed to open at a preset temperature which will eventually occur in the chamber 52 if there is insufficient circulating air across the heat exchanger assembly 18 during periods in which hot gases are flowing through the heat exchanger 30. If the limit switch 60 opens, the microprocessor control 54 automatically shuts off the gas and brings on the blower 26 at high speed to cool off the heat exchanger 30. After a predetermined time delay, the limit switch is reset and the system commences another heating cycle. However, in accordance with the present invention, the usual method is modified in such a way as to address one of the more common causes for a tripping of the limit switch 60.

The present invention recognizes that the high fire solenoid within the gas valve may be susceptible to sticking in the closed position such that when the system is operating in a low fire condition, poor combustion would result. This would normally bring about an opening of the limit switch and, if it should occur repeatedly, the system will not complete a heating cycle during that time. The present invention is therefore intended to change the process to cause the system to sense such a condition and to deviate from the normal process by operating in a modified, safe, condition (i.e. in a high heat only mode) so as to prevent poor combustion and to complete the heating cycle. The system will resume normal operation after 115 Volt AC power is reset. Once in this high heat only mode of operation, the limit switch still continues to open over a predetermined, relatively high number of cycles, or if other fault conditions are sensed, the system will be caused to lock out and corrective action will then be necessary.

Figure 2:
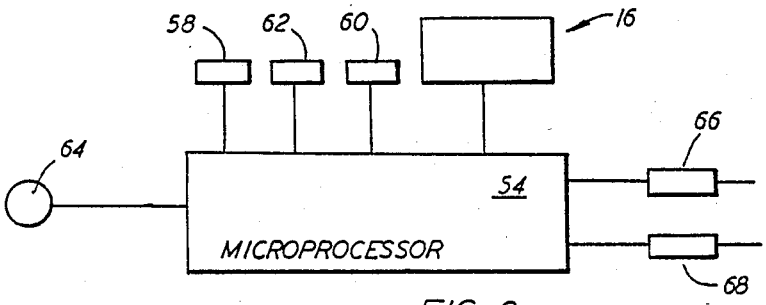
FIG. 2 is a block diagram of a portion of the furnace control system.

Referring now to FIG. 2, there is illustrated a simplified block diagram illustrating the interconnection between microprocessor control 54 and pressure switches 58 and 62, limit switch 60, thermostat 64, gas valve 16, air blower motor control 66 for air blower 26, and inducer motor control 68 for motor 22. Both controls 66 and 68 generate respective RPM pulse signals and contain respective optical couplers to isolate the respective RPM pulse output signal.

As part of the control function of the microprocessor 54, it is desired to monitor the limit switch 60 and to determine when it is caused to open, and to record and count the number of times in consecutive cycles that it does open when either in the low or high fire modes. This is accomplished by internal counters within the microprocessor, one counter being capable of counting the occurrences of the limit switch 60 opening when the system is operating in the low heat mode and the other being capable of counting the occurrences of the limit switch 60 opening when the system is operating in the high heat mode.

Figures 3, 3A:
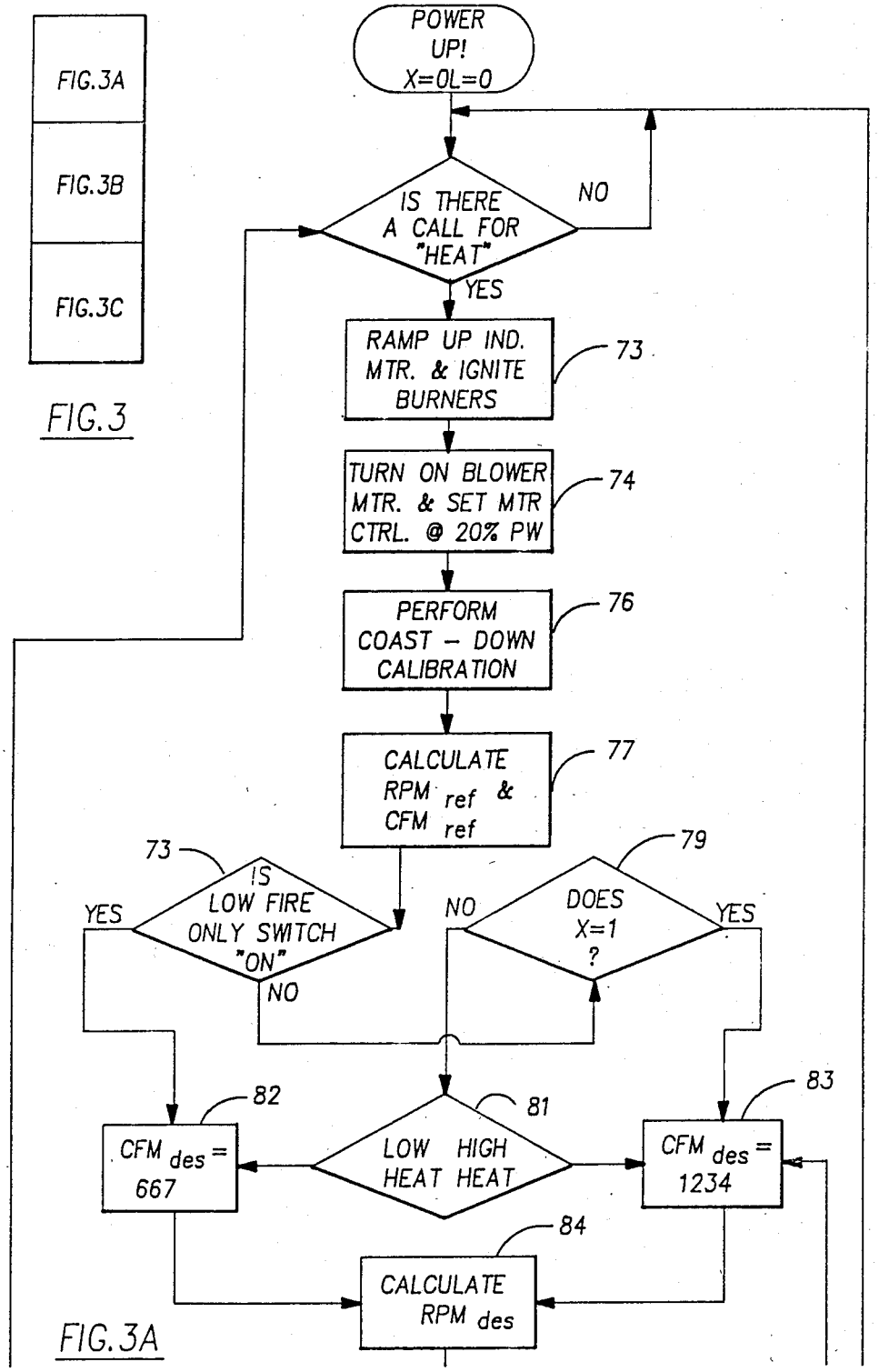
FIGS. 3A, 3B and 3B show a flow diagram illustrating the method of operating a furnace control system in accordance with the present invention.
Figure 3B:
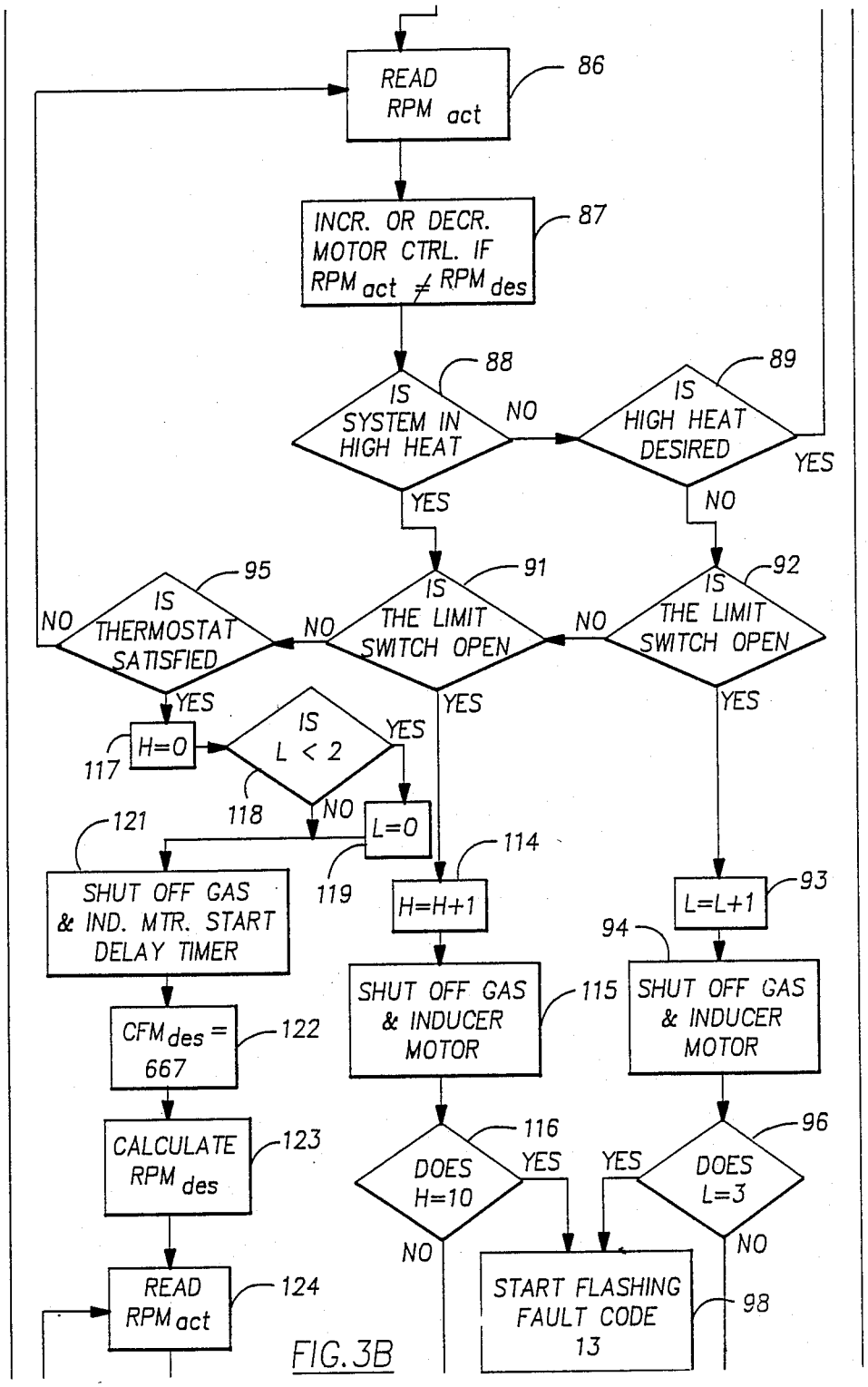

In the description that follows with reference to FIGS. 3A, 3B, and 3C, each of the steps can represent a subroutine or a series of steps in the heating cycle.

Microprocessor control 54 has its control logic programmed to follow instructions given at each step. Control 54 is programmed to receive inputs, process inputs, and generate outputs in response thereto. Referring now to FIG. 3A, block 71 represents the system in its normal condition with power on, for the normal mode of operation (X=0), and with the low fire limit switch cycle counter at 0 (L=0) before stepping to block 72. When there is a call for heat, the microprocessor 54 steps to block 73 wherein the control 54 checks the status of the low heat 58 and high heat 62 pressure switches to ensure that they are open, after which the inducer motor 22 is started and accelerated to a predetermined speed. When the low pressure switch 58 closes, this is sensed by the microprocessor control 54 which then supplies power to an open set of contacts in the ignition relay (not shown). As the speed of the motor 22 continues to be increased, high pressure switch 62 closes thereby causing microprocessor 54 to generate a signal to gas control 16 to energize the high heat solenoid (not shown). At this point, the speed of the motor 22 is maintained constant by the microprocessor 54 for a period of ten seconds to purge the burner assembly 14 and heat exchanger assembly 18.

Still at block 73, after the ten second purge, the microprocessor control 54 energizes the ignition relay which closes a set of contacts and provides power to gas control 16 to energize the pilot gas valve pick and hold coils and sparker, and the flame provided thereby is proved by a flame proving contact, following which the main valve (not shown) in gas control 16 is energized. With the main valve open, inshot burner 28 is ignited to burn the mixture of fuel and air delivered thereto. Microprocessor control 54 then causes gas control 16 to provide a relatively high flow rate of gas to sustain the high heat mode for a period of one minute to ensure proper burner ignition and to quickly heat the surfaces of heat exchanger assembly 18. After the one minute of high heat, the microprocessor 54 generates a signal to the inducer motor control 68 to slow the inducer motor 22 to a speed that opens the high pressure switch 62 but maintains the low pressure switch 58 in a closed position. Also, passing on to block 74, the microprocessor control 54 generates a signal to the air motor blower control 66 to begin operation of the air blower 26 to deliver a flow of air to be heated through passage 52. Further, in response to the opening of high pressure switch 62, microprocessor control 54 generates a signal to the gas control 16 to provide a lower gas flow rate for the low heating mode. The motor controller automatically sets the motor speed by establishing a 20 percent pulse width mode of operation. In order to sense the load on the system and to adjust the blower speed accordingly, the microprocessor control 54 then steps to block 76 wherein the coast-down calibration procedure is initiated. This is more fully described in U.S. Pat. application Ser. No. 144,682 filed on Jan. 13, 1988, and assigned to the assignee of the present invention. As a result of this procedure, the reference motor speed (RPM ref) and reference airflow volume (CFM ref) are calculated as indicated in block 77.

In establishing the speed of the blower 26, the system inquires whether a low fire or a high fire condition is demanded. If a "low fire only" switch is on (block 78), or if the system is calling for the normal mode of operation (X=0) rather than the high fire only (X=1) as shown in block 79, then the system steps to block 81 wherein a choice is made on the basis of a thermostat algorithm. This thermostat algorithm is more fully described in U.S. Pat. No. 4,638,942 issued on Jan. 27, 1987, and assigned to the assignee of the present invention. As a result of this procedure, the system will generally move on to block 82 wherein the desired airflow (CFM des) for low fire operation is read. The system then proceeds to block 83 wherein the desired fan motor speed (RPM des) is calculated. Similarly, if, back in block 79, high heat only (X=1) is being called for, or the thermostat algorithm chooses high heat, then the system steps to block 83 wherein the desired airflow for high fire operation is read (CFM des) and the desired blower motor speed (RPM des) is calculated in block 84 for that condition. Then, at all times during operation of the blower 26, the actual speed thereof is being sensed at block 86 and being compared with the desired speed as calculated in block 84. The motor controller then increases or decreases the motor speed so as to maintain the actual speed equal to the desired speed. This step occurs in block 87.

As will be seen in blocks 88 and 89, the system, if running in the low heat mode, can be forced to operate in the high heat mode of operation after running a predetermined amount of time in the low fire mode, whereby inputs are entered into the microprocessor control 54 to change from low to high fire mode. If the system is in a high heat mode, the system steps to block 91, whereas if it is not, the system steps to block 89. Here, the microprocessor 54 determines whether high heat is desired, in which case the system steps to block 83, or whether high heat is not desired, in which case the system steps to block 92.

As discussed hereinabove, the limit switch 60 is provided to sense if and when the air in the air passage 52 reaches a predetermined temperature limit, at which time the switch 60 will open and a fault will be indicated. Whether operating in the high or low heat condition, if the limit switch 60 is not open, the system steps to block 95 wherein a determination is made as to whether or not the thermostat is satisfied. If it is not, the system remains in the closed loop operation between block 86 and block 95. If, at this point, the thermostat is satisfied, then a satisfactory cycle has been completed and the system will be reset to operate in a normal manner, despite what might have occurred in progressing toward a forced high fire or a lock out condition. Further discussion of the remaining portion of this loop will therefore be reserved until after discussion of the occurrences which tend to progress toward a forced high fire or a lock out position.

Assuming, first of all, that the system is operating in a low fire mode as suggested by block 89 and that the limit switch opens as indicated in block 92. Then the low fire limit switch cycle counter has a one added to it (L+1) as indicated in block 93. The total number on this counter will be significant in a later part of the process. In block 94, the gas is shut off and the inducer motor is turned off. In block 96, the microprocessor inquires as to the total number L on the low fire limit switch cycle counter and, if this total number L is not equal to three, the system steps on to block 97 wherein a flashing fault code 33 is initiated to indicate that a limit switch has opened. If, on the other hand, the low fire limit switch cycle counter does show a total L of three, then the system steps to block 98 wherein a flashing fault code 13 is initiated to indicate that a system lock out condition exists. In either case, the next step is to bring on the blower at high speed to thereby cool off the heat exchanger. This occurs in blocks 99, 101, 102, and 103 in the same manner as described hereinabove. Pursuant to the step in block 103, the system will then maintain the desired blower speed until a prescribed period of time (e.g. one minute) in which the limit switch 60 is reset as indicated in block 104. At this time, the blower is then shut off as shown in block 106 and the system steps to block 107 wherein both the low fire limit switch cycle counter and the high fire limit switch cycle counter are queried to determine the total number of consecutive cycle openings for each of the respective counters. If the total L on the low fire limit switch cycle counter is less than two, then the system steps to block 108 wherein the flashing fault code 33 is discontinued and then back to block 72 wherein the normal cycle is resumed. If, on the other hand, the number L on the low fire limit switch cycle counter is two or greater, or if the number H on the high fire limit switch cycle counter is ten, then the system steps to block 109 wherein an additional query is made of the counters. If the total L on the low fire limit switch cycle counter is equal to three or if that H on the high fire limit switch cycle counter equals ten, then the system passes to block 111 wherein lock out occurs and the fault code 13 continues to flash. The operator then knows that the system will require a power reset before it will again operate. If L does not equal three (i.e. $L=2$) or H does not equal ten, then the system passes to block 112 such that the fault code 33 continues to flash, and then to block 113 wherein the system is then restricted to operate in a high heat only condition ($X=1$). The system then returns to block 72 wherein the normal operation is resumed, except that now, the system is restricted to the high heat only condition. This may be preempted only by the system going into a "low fire only" mode of operation as indicated in block 78 as will now be described. The "low fire only" mode of operation can be entered either by the operator's manually selecting a particular configuration switch setting or it may be entered by the system automatically as a result of the occurrence of a predetermined fault condition. In either case, the block 78 will cause the system to step to block 82 through blocks 84, 86, 87, 88, 89, 92, and finally to block 93 wherein the low fire limit switch cycle counter adds another digit. Thus, if the number L on that counter had been two as determined by block 112 to thereby initiate a high heat only mode of operation as indicated by block 113, then the number will now be three ($L=3$) to thereby cause the system to step from block 96 to block 98 to thereby start the flashing of the fault code 13, and later to cause the system to step from block 109 to block 111 wherein the system locks out.

Referring now to the condition wherein the high heat is being called for as indicated in block 88 and the limit switch 60 opens as indicated in block 91, the system then steps to block 114 wherein the high fire limit switch cycle counter has another digit added thereto ($H+1$). Again, since the limit switch 60 has opened, the gas and the inducer motor are shut off as indicated in block 115. This system then steps to block 116 wherein the high fire limit switch cycle counter is queried as to the total number H of limit switch openings in consecutive high fire cycles. If the limit switch 60 has opened once on each of ten consecutive cycles while in the high fire mode ($H=10$), then the system will step to block 98 to start the flashing of the fault code 13, and the system will also subsequently step from block 109 to block 111 where the system goes to lock out and the fault code 13 continues to flash. If that number has not reached ten (i.e. $H<10$) then the system passes to block 97 wherein the flashing fault code 33 commences or continues to flash. In any case, the system blower will come on at high speed and remain there, as indicated in block 99, 101, 102, and 103 until the limit switch resets at block 104 and the blower is shut off at block 106.

It will thus be seen that if the limit switch 60 opens once in each of two consecutive cycles while in the low fire mode, the system will automatically restrict the operation to high heat only, with normal heating operation resuming only after the power is reset. While in this forced high heat only mode of operation, if the system is made to go into a preemptive "low heat only" mode of operation, and while in this mode the limit switch 60 opens, then the system will be locked out. Further, if the limit switch 60 opens on each of ten consecutive cycles while in the high fire only mode, the system will lock out. Returning now to the condition wherein the thermostat is satisfied as indicated at block 95, it will be seen that provision is made to reset the low and high fire limit switch cycle counters when a normal cycle is concluded with the thermostat being satisfied and the limit switch not opening. That is, at block 117, the high fire limit switch cycle counter is reset to 0 and, as indicated at block 118, if the low fire limit switch cycle counter number L is less than two, then the low fire limit switch cycle counter is reset to 0 at block 119. Of course, if that number equals two, then the system will remain in a high fire only mode of operation until the power is reset. Completing the cycle then, after the thermostat is satisfied, the gas and the inducer motor are shut off and a delayed timer is started. The blower then operates at low fire speed as established in blocks 122, 123, 124, and 126 until the timer has timed out as indicated at block 127, after which the blower is shut off at block 128. The system then returns to the normal cycle at block 72.

While the present invention has been disclosed with particular reference to a preferred embodiment, the concepts of this invention are readily adaptable to other embodiments, and those skilled in the art may vary the structure thereof with out departing from the essential spirit of the invention.

What is claimed is:

1. A method of operating a gas furnace of the type having a control system for selectively operating in either of two stages of operation and a gas valve which is responsively operable in either a low or high fire mode comprising the steps of:

determining whether, when the control system is calling for a low fire mode, the gas valve is in a high fire mode; and responsively restricting the control system to operation in a high fire only mode.

2. A method as set forth in claim 1 wherein said step of determining that the gas valve is in a high fire mode when the control system is calling for a low fire mode is accomplished by sensing when a predetermined temperature is exceeded in the system.

3. A method as set forth in claim 2 wherein the furnace includes a heat exchanger and a blower for circulating the air through a chamber over the heat exchanger and further wherein said temperature to be sensed is that in said chamber.

4. A method as set forth in claim 3 wherein the control system includes a counter for counting the number of times when said predetermined temperature is exceeded in consecutive heating cycles and including the step of responsively restricting the control system to operation in the high heat only mode when that number exceeds a predetermined limit.

5. A method as set forth in claim 3 wherein said control system further includes a counter for counting the number of times when said predetermined temperature is exceeded while in the high heat mode and further including the step of locking the system out from further operation when said counter indicates a predetermined number of openings in a predetermined number of consecutive heating cycles.

6. A method as set forth in claim 1 wherein the control system includes a provision for selecting a preemptive low fire only mode of operation and further including the steps of determining whether, when the control system is in a low fire only mode, the predetermined temperature is exceeded, and if so, then locking the system out.

7. In a gas furnace system of the type having a gas valve which is operable to either a high fire or a low fire condition in response to a control system, a method of operating the system comprising the steps of:

determining whether the gas valve is in a high fire condition when the control is calling for low fire condition; and responsively restricting the control system to high fire operation.

8. The method of claim 7 wherein the restricting step is accomplished only when the step of determining is accomplished in each of two consecutive cycles of operation.

9. A method as set forth in claim 7 wherein said step of determining is accomplished by the sensing of a predetermined temperature level in the system.

10. A method as set forth in claim 9 wherein said furnace system includes a heat exchanger disposed in a heating chamber through which circulating air is passed and further wherein said step of determining is accomplished by sensing the temperature in said heating chamber.

11. A method of operating a furnace system of the type having a limit switch for sensing the temperature in a circulating air chamber around the heat exchanger and for responsively shutting down portions of the system when the temperature reaches a predetermined limit, including the steps of:

sensing, in consecutive heating cycles, when the temperature in the circulating air chamber reaches the predetermined limit;

counting the number of times when the predetermined temperature is reached in consecutive heating cycles; and when said number reaches the predetermined level, shutting down the system from further operation.

12. The method as set forth in claim 11 wherein said furnace system includes a two-stage system capable of operating in either high fire or low fire conditions and further wherein said step of counting is applicable under high fire conditions.

13. A method as set forth in claim 12 wherein said furnace system includes a control function for preemptively placing the system in a low fire only mode of operation, and including the further steps of, determining whether, when the control system is in a low fire only mode, the predetermined temperature is exceeded, and if so, then locking the system out.

* * * * *